US011180940B2

(12) United States Patent
Kelley

(10) Patent No.: US 11,180,940 B2
(45) Date of Patent: Nov. 23, 2021

(54) GARAGE DOOR NOISE REDUCTION ROLLER ASSEMBLY WITH NOISE REDUCTION ROLLER WHEEL

(71) Applicant: Robert A. Kelley, Moreno Valley, CA (US)

(72) Inventor: Robert A. Kelley, Moreno Valley, CA (US)

( * ) Notice: Subject to any disclaimer, the term of this patent is extended or adjusted under 35 U.S.C. 154(b) by 356 days.

(21) Appl. No.: 15/845,147

(22) Filed: Dec. 18, 2017

(65) Prior Publication Data

US 2019/0106919 A1 Apr. 11, 2019

Related U.S. Application Data

(63) Continuation-in-part of application No. 14/827,259, filed on Aug. 14, 2015, now Pat. No. 10,280,667.

(51) Int. Cl.
*E05D 15/24* (2006.01)
*E05D 11/00* (2006.01)

(52) U.S. Cl.
CPC ..... *E05D 15/242* (2013.01); *E05D 11/00* (2013.01); *E05Y 2800/422* (2013.01); *E05Y 2800/45* (2013.01); *E05Y 2800/676* (2013.01); *E05Y 2900/106* (2013.01); *E05Y 2900/132* (2013.01)

(58) Field of Classification Search
CPC ..... E05F 15/165; E05F 15/242; E05F 15/16; E05F 15/24; E05Y 2800/676; E05Y 2800/45; E05Y 2800/422; E05Y 2900/106; E05Y 2900/132
See application file for complete search history.

(56) References Cited

U.S. PATENT DOCUMENTS

| | | | | |
|---|---|---|---|---|
| 1,501,743 A | | 7/1924 | Bowen | |
| 1,687,113 A | | 10/1928 | Stockdale | |
| 2,525,309 A | * | 10/1950 | Norberg | E05D 15/242 16/97 |
| 2,645,807 A | * | 7/1953 | McKee | E05D 15/242 16/97 |
| 3,666,322 A | * | 5/1972 | Pickron | B62D 55/0966 301/64.701 |
| 3,843,202 A | * | 10/1974 | Lacerte | B60B 33/0028 301/64.701 |

(Continued)

*Primary Examiner* — Catherine A Kelly
*Assistant Examiner* — Abe Massad
(74) *Attorney, Agent, or Firm* — Minta Law Group LC; Veronica-Adele Dela Roca Cao

(57) ABSTRACT

A roller with a plastic injection tube to coat the steel shaft wherein the plastic coated shaft eliminates the metal-to-metal contact that creates the noise. Closing the gap between the metal roller shaft and hinge barrel will eliminate the metal-to-metal contact resulting in a very quiet, rolling garage door. Further disclosed is an improved roller wheel having a tire made of material selected from the group consisting of urethane and urethane (PER) on which the roller will roll within a garage door track to significantly reduce the noise of the roller as it rolls inside the garage door tracks as the garage door is raised and lowered. The improved wheel include two plastic wheel sections with a gap therebetween with the tire made of urethane (PER) molded between the two sections and also extending through openings within the two wheel sections to retain the two wheel sections together.

12 Claims, 12 Drawing Sheets

(56) References Cited

U.S. PATENT DOCUMENTS

| | | | | | |
|---|---|---|---|---|---|
| 4,205,713 | A * | 6/1980 | Galbreath | E05D 15/165 | 160/201 |
| 4,818,034 | A | 4/1989 | Djerf | | |
| 5,031,269 | A | 7/1991 | Lautenschlager et al. | | |
| 5,129,709 | A | 7/1992 | Klamer | | |
| 5,169,237 | A | 12/1992 | Domenig | | |
| 5,275,473 | A | 1/1994 | Hicks | | |
| 5,308,152 | A * | 5/1994 | Ho | A63C 17/06 | 152/323 |
| 5,401,037 | A | 3/1995 | O'Donnell et al. | | |
| 5,447,377 | A * | 9/1995 | Baumgartner | F16C 13/006 | 384/477 |
| 5,487,610 | A * | 1/1996 | Lautenschlager | B60B 33/00 | 384/19 |
| 5,853,226 | A | 12/1998 | Lee | | |
| 6,185,783 | B1 * | 2/2001 | Carpinella | E05D 15/165 | 16/107 |
| 6,309,025 | B1 | 10/2001 | Huang | | |
| 6,553,618 | B2 * | 4/2003 | Whitley | E05D 15/165 | 16/107 |
| 9,856,685 | B1 * | 1/2018 | Kelley | E05D 15/242 | |

* cited by examiner

GARAGE DOOR NOISE REDUCTION ROLLER ASSEMBLY WITH NOISE REDUCTION ROLLER WHEEL

CROSS-REFERENCE TO RELATED APPLICATION

This patent application is a continuation-in-part of application Ser. No. 14/827,259 filed on Aug. 14, 2015, now pending.

BACKGROUND OF THE INVENTION

1. Field of the Invention

The present invention relates to the field of garage doors and in particular, to garage door rollers. These rollers allow the garage door to open and close along a guide track. Rollers are located on either side of the garage door and are positioned within a respective track located on opposite sides of a garage door. The rollers roll along a track as the garage door is raised or lowered. Each roller is respectively affixed to a collar by which the respective roller is retained. Each respective roller is affixed to a receiving member of a respective garage door hinge plate which in turn is affixed to a garage door plate, which in turn is affixed to a garage door. The present invention relates to improvements in the roller to reduce the noise created by the steel roller shaft hitting the respective garage door plate as the garage door is raised and lowered.

2. Description of the Prior Art

In the prior art which is known to the present inventor, most garage door rollers have a plated steel shaft that slides into a tube just slightly larger than the diameter of the shaft. This tube is part of a hinge that the roller is retained in to help move the sectional garage door up and down. The hinge is attached to multiple sections of the garage door. The shaft of the roller and tube of the hinge are made of steel. The gap between the roller shaft and the hinge tube allow it to move freely and side to side without binding or sticking. The problem is that the gap/clearance and both the roller shaft and hinge tube barrel being made of steel causes noise and rattling by the metal-to-metal contact as the garage door is raised and lowered. Putting lubricant between the shaft of the roller and the tube into which it is inserted provides some lubricant benefit but still does not significantly reduce the noise and rattling of the assembly.

It was previously believed that the problem is not the roller wheel itself because that is not where the noise comes from. The noise comes from the steel shaft of the roller wheel that slides into a hinge bracket in the hinge affixed to garage door sections. The steel garage door hinges and fixtures have a tube or round bracket that retains the roller's shaft. This allows the roller to be retained and allows the shaft to move freely side to side. As the garage door rolls up and down, the rollers move freely and the space in between the tube and roller shaft causes a rattle because of the metal-to-metal contact. This is why the door sounds shaky and noisy when it is in motion. Greasing or lubricating the rollers will not fix the problem of the rattling sound. Even installing the quietest belt drive garage door opener with the quietest hinges and best precision 13-ball rollers will not guarantee that the door will be rattle-free in operation.

In the prior art, the rollers are affixed to a metal shaft which is in turn affixed to a plate, which in turn is affixed to the rear of a garage door so that as the garage door is raised, the rollers which are positioned on opposite sides of the garage door and also positioned within a track, roll or rotate within the track to enable the garage door to be raised or lowered. The rollers are affixed to the shaft and the shafts that are usually made of metal make a clanging and unpleasant noise as the garage door is raised up and down. The problem with the prior art is that the shaft of the rollers is metal and the shaft comes into metal-to-metal contact with the plate to which the shaft is inserted so that there is a constant clanging noise as the garage door is raised and lowered. One other solution that has been attempted in prior art is to create a plastic hinge barrel but strength is sacrificed and the customer usually perceives the plastic hinge barrel to be weak and inferior. Further, the gap remaining between the plastic hinge barrel and the door still creates a rattling noise while traveling up and down. The gap between the shaft of the roller and the tube into which the shaft is inserted still remains and still creates a lot of noise when the garage door is raised and lowered. There is a significant need for a quieter roller shaft assembly so that there is less noise when the garage door is raised and lowered.

The prior art does not significantly reduce the noise created by the shaft of a roller inserted into a tube or hinge bracket as the roller moves up and down to enable the garage door to be raised and lowered. In the garage door, there are tracks on either side of the garage door and a roller is inserted into each track in order to enable the garage door to be raised and lowered. There may be multiple rollers along various lengths of the garage door and in particular, affixed to respective horizontal panels of the garage door. The roller in turn is attached to a shaft which in turn is inserted into a tube that is affixed to a hinge attachment plate which is affixed to the garage door. Therefore, as the garage door is raised and lowered, the metal of the shaft from the roller and the metal of the tube into which the shaft is inserted, have a metal-to-metal contact creating a lot of noise as the garage door is raised and lowered.

Subsequent to filing the parent application, the present inventor discovered that the roller wheel inside the garage door track also contributes to the noise as the garage door rolls up and down. Improvements in roller wheel design are known. The following sets forth a list of prior art patents on improvements to a roller wheel. The present inventor was made aware of certain prior art before the this continuation-in-part patent application was filed. The following sets forth a list of the prior art.

1. U.S. Pat. No. 1,501,743 issued to James Bowen on Jul. 15, 1924 for "Caster Wheel".
2. U.S. Pat. No. 1,687,113 issued to William A. Stockdale on Oct. 9, 1928 for "Caster".
3. U.S. Pat. No. 4,818,034 issued to Tobin Djerf on Apr. 4, 1989 for "Shock Absorbing Wheel".
4. U.S. Pat. No. 5,031,269 issued to Horst Lautenschläger et al. on Jul. 16, 1991 for "Wheel for Rolling Drawer Slides".
5. U.S. Pat. No. 5,129,709 issued to Reuben Klamer on Jul. 14, 1992 for "Wheel for Roller Skate and The Like".
6. U.S. Pat. No. 5,169,237 issued to Georg Domenig on Dec. 8, 1992 for "Supporting and Guide Roller for Pull-Out Guides for Drawers".
7. U.S. Pat. No. 5,275,473 issued to Jimmy L. Hicks on Jan. 4, 1994 for "Shopping Car Wheels with Polymeric Bearing Races".
8. U.S. Pat. No. 5,401,037 issued to Patrick J. O'Donnell et al. on Mar. 28, 1995 for "Composite Wheels for In-Line Roller Skates".

9. U.S. Pat. No. 5,853,226 issued to Charles J. Lee on Dec. 29, 1998 for "High Performance In-Line Roller Skate Wheels with Permeable Cores".
10. U.S. Pat. No. 6,309,025 issued to Ing-Chung Huang on Oct. 30, 2001 for "Roller Skate Wheel Assembly".
11. U.S. Pat. No. 6,553,618 issued to L. Blake Whitley on Apr. 29, 2003 for "Dual Durometer Roller Guide Member for Track Guided Door".

There is a significant need in the garage door industry for a quieter garage door roller. Over the years, rollers have been made of steel and plastic, with and without bearings and a plastic cover put over the roller wheel itself as improvements to make them quieter, which has not significantly reduced the noise. In addition, there is a significant need to reduce the noise of the roller wheel in a garage door track.

SUMMARY OF THE INVENTION

The present invention is an apparatus to reduce noise created by the shaft of a respective roller being inserted into a respective metal retaining member of a respective hinge plate where a multiplicity of hinge plates are affixed to adjacent panels of a garage door while a pair of oppositely disposed rollers respectively travel along a pair of oppositely disposed tracks adjacent opposite ends of a garage door panel as the garage door is raised and lowered.

Through experiments performed by the present inventor, it has been discovered that if the roller shaft is coated with or covered with a hard thermoplastic injection molding, then the metal-to-metal noise of the roller shaft retained in the metal barrel of a hinge plate is significantly reduced when the garage door is raised or lowered.

According to the present inventor, it has been discovered that an improved roller assembly is created with ball bearings and a hard plastic tire such as a Delrin® plastic tire and a thermoplastic injection molded covered metal roller shaft. The difference would be a thermoplastic injection molded roller shaft cover. The thermoplastic injection molded shaft cover would be thin enough to still provide side-to-side non-binding movement. It would also provide a cushion/sound absorption effect and eliminate metal-to-metal contact. Thermoplastic injection molded material is tough enough to resist the chemicals that the door hinge is subject to when lubricated. It should be noted that other types of plastic and urethane covering the roller shaft are also within the spirit and scope of the present invention to achieve the same result.

It has been further discovered that utilizing thermoplastic injection molded material is the most cost effective way to achieve the quiet rattle-free operation of the roller plus chemical resistance. The thermoplastic injection molding will remain on the metal roller shaft with or without the use of glues or adhesive. Not having to use glues or adhesives makes it very cost effective. Therefore, the thermoplastic injection molded covered metal roller shaft could be offered on most garage door rollers at very little cost to the homeowner for a much greater rattle-free garage door. In addition, the thermoplastic injection molded covered metal roller shafts fit most standard garage door hinges.

It has further been discovered according to the present inventor that reducing the diameter of the steel on the metal roller shaft and adding the injection molded plastic on the top will not achieve a lasting result. Injection molded plastic on a smooth steel shaft will result in failure. The weight of the garage door transfers through the hinge and onto the shaft. The weight plus the side-to-side friction and force of motion on the metal roller shaft will push the plastic cover off like a tube.

It has been discovered that a significant improvement is to have threads or grooves or a valley on the metal roller shaft to facilitate an extra grip for the injection molded plastic to grab onto. A gripping joint to allow injection molded plastic to penetrate and wrap around the metal roller shaft will significantly reduce the noise of the garage door as it moves up and down. With the plastic embedded in and around the steel shaft of the roller, there is very reduced possibility for it to become loose or dislodged from the metal roller shaft. This provides a permanent lock and bond to the metal roller shaft. It also results in a long lasting achievable noise reducing assembly to enable the rollers to roll up and down within their tracks and reduce the noise by eliminating a metal-to-metal contact between the shaft of the roller and the tube of the hinge which attaches the assembly to the garage door.

It is therefore an object of the present invention to provide a roller with a plastic injection cover to coat the steel of the metal roller shaft wherein the plastic coated metal roller shaft eliminates the metal-to-metal contact that creates the noise. In a preferred embodiment, the new and improved plastic coated shaft will be 1 mm larger than industry standard shafts because 10-11 mm industry standard shafts are too loose in the hinge barrels which allows the rattling. This improved metal roller shaft is 12 mm at finished thickness to reduce the extra space. Closing the gap between the metal roller shaft and hinge barrel will eliminate the metal-to-metal contact resulting in a very quiet, rolling garage door. By keeping the finished thickness at 12 mm on the new shaft, the roller will still work on new and old garage door hinges and fixtures.

Subsequent to the filing of the parent application, it was discovered by the same inventor that the pair of oppositely disposed rollers or roller wheels also contributed to the noise as the garage door moves up and down. The noise reduction of the metal roller shaft rotatably connected to the hinge plate which was the subject of the parent application is a significant improvement in noise reduction. The present invention further improves the noise reduction.

It is an additional object of the present invention to provide an improvement in the wheel design which substantially reduces the noise of the wheel as it rolls in a garage door track.

It has been discovered that the garage roller wheel can be split into two wheel halves and the injection of material selected from the group consisting of urethane (PER) (hereafter defined as "urethane (PER)" except for use in the claims and the duplication of the claims at the end of the Summary of the Invention section) in the gap between the two-piece wheel during the formation of the two-piece wheel provides a tire effect where the wheel rolls on urethane (PER) instead of metal substantially reducing the noise of the wheel as it rolls in a garage door track.

It has further been discovered that if each plastic wheel has holes running through the thickness of each wheel, injecting material selected from the group consisting of urethane (PER) into a gap between two integrally connected sections of the wheel enables the urethane (PER) to protrude throughout the insides of the two integrally connected sections and out preexisting holes to form a small tire and retain the two wheel halves together.

It is therefore an object of the present invention to create a noise reduction wheel through injection of material selected from the group consisting of urethane (PER) during the formation of the wheel by injecting urethane (PER) into a gap between two sections of the wheel and allowing the urethane (PER) to protrude throughout the insides and out preexisting holes to form a small tire. The wheel rides on urethane (PER) instead of steel, thereby significantly reducing noise as the wheel rolls in a garage door track.

It is an additional object of the present invention to provide an improved roller wheel having a tire made of material selected from the group consisting of urethane (PER) on which the roller will roll within a garage door track to significantly reduce the noise of the roller as it rolls inside the garage door tracks as the garage door is raised and lowered. The improved wheel include two plastic wheel sections with a gap therebetween with the tire made of material selected from the group consisting of urethane (PER) molded between the two sections and also extending through openings within the two wheel sections to retain the two wheel sections together.

Defined in detail, the present invention is a hinge used in conjunction with and affixed to two adjacent garage door panels, the hinge including a roller wheel which is placed into a track of a garage door opening so that a garage door can be rolled up and down with a pair of oppositely disposed roller wheels respectively set within oppositely disposed tracks adjacent opposite ends of the garage door, the roller wheel including a metal collar with a metal roller shaft retained into the roller wheel, the metal roller shaft inserted into aligned openings in metal hinge brackets with a respective pair of metal hinge brackets incorporated into a respective metal hinge plate including openings to receive affixing members by which the each respective metal hinge plate is affixed to a garage door, the hinge and the roller wheel comprising: (a) the metal roller shaft including a tube retaining member; (b) a plastic tube having a cylindrical outer wall and a cylindrical inner chamber surrounded by the cylindrical outer wall and open at a first end and at a second end, the plastic tube fitted over the metal roller shaft through the first opening and the second opening and retained on the metal roller shaft by the tube retaining member; (c) the plastic tube covered metal roller shaft inserted through the respective aligned openings in the hinge brackets so that the plastic tube prevents metal to metal contact between the metal roller shaft and the metal hinge brackets and metal hinge plates; and (d) each respective roller including a ball bearing assembly and a metal separator with two spaced apart wheel sections with a gap over the metal separator and between the two wheel sections with a multiplicity of holes in each of the two wheel sections, a tire made of material selected from the group consisting of urethane and polyurethane (PER) within said gap and having a diameter larger than each respective wheel section with polyurethane extending through each respective hole in each respective wheel section, each respective roller wheel rolling on its respective tire within a respective track.

Defined more broadly, the present invention is a hinge affixed to and adapted for use with two adjacent garage door panels with a garage door track adjacent aligned ends of the adjacent garage door panels and a roller wheel adapted to roll inside the garage door track, the hinge having two hinge plates with a respective hinge plate affixed to a respective one of the adjacent garage door panels, the two hinge plates rotatably connected by a metal roller shaft rotatably inserted between metal extensions aligned hinge plates, the metal roller shaft having a metal roller wheel at on end of the metal roller shaft and rollably retained within the garage door track, the hinge and roller wheel comprising: (a) a plastic tube retained on the metal roller shaft, the plastic tube positioned between the metal roller shaft and the metal extends; and (b) the roller wheel including a ball bearing assembly and a metal separator with two spaced apart wheel sections with a gap over the metal separator and between the two wheel sections with a multiplicity of holes in each of the two wheel sections, a tire made of material selected from the group consisting of urethane and polyurethane (PER) within said gap and having a diameter larger than each respective wheel section diameter with polyurethane extending through at least two holes in each respective wheel section, the roller wheel rolling on its tire made of material selected from the group consisting of urethane and polyurethane (PER) within the garage door track.

Defined most broadly, the present invention is a roller wheel connected to a metal roller shaft rotatably interconnecting a hinge assembly having attaching members affixed to adjacent garage door panels, the roller wheel adapted to roll inside a garage door track positioned adjacent a respective aligned end of the adjacent garage door panels, the roller wheel comprising: (a) a collar retaining one end of the metal roller shaft, a ball bearing assembly aligned with the collar and a separator encircling the ball bearing assembly, a first wheel section adjacent a first radial side of the separator and a second wheel section adjacent an opposite side of the wheel separator, the first wheel section having a first multiplicity of spaced apart transverse openings, the second wheel section having a second multiplicity of spaced apart transverse openings, a circumferential gap surrounding the separate and between said first wheel section and said second wheel section; (b) a tire made of polyurethane within said gap, the polyurethane extends into said first multiplicity of transverse openings and said second multiplicity of transverse openings, the tire having a tire diameter larger than a first diameter of the first wheel section and larger than a diameter of the second wheel section, the roller wheel rotatably traveling in said garage door track on said tire made of polyurethane.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The parent application addressed the following problem with noise created when a garage door is moving up or down. When the parent application was filed, it was believed that the problem was not the roller wheel itself. The parent application addressed the perceived problem was that the noise came from the steel shaft of the roller that slides into the hinge and fixtures (top and bottom door brackets) of the garage door.

A problem with noise is that the steel garage door hinges and fixtures have a tube or round bracket that retains the roller's shaft. This allows the roller to be retained and allows the shaft to move freely side to side. As the garage door rolls up and down, the rollers move freely and the space in between the tube and metal roller shaft causes a rattle because of the metal-to-metal contact. This is why the door sounds shaky and noisy when it is in motion. Greasing or lubricating the rollers will not fix the problem of the rattling sound. Even installing the quietest belt drive garage door opener with the quietest hinges and best precision 13-ball rollers will not guarantee that the door will be rattle-free in operation.

The parent application invention is a roller with a Delrin® plastic injection to coat the steel shaft wherein the plastic coated shaft eliminates the metal-to-metal contact that creates the noise. The new and improved Delrin® plastic coated shaft will be 1 mm larger than industry standard shafts because 10-11 mm industry standard shafts are too loose in the hinge barrels which allows the rattling. This improved metal roller shaft is 12 mm at finished thickness to reduce the extra space. Closing the gap between the metal roller shaft and hinge barrel will eliminate the metal-to-metal contact resulting in a very quiet, rolling garage door. By keeping the finished thickness at 12 mm on the new shaft, the roller will still work on new and old garage door hinges and fixtures. This makes the new and improved metal roller shaft a truly universal product that will work on 90% of garage doors in service and almost all new models. This is a long over-due improvement to garage door rollers.

Figure 1:
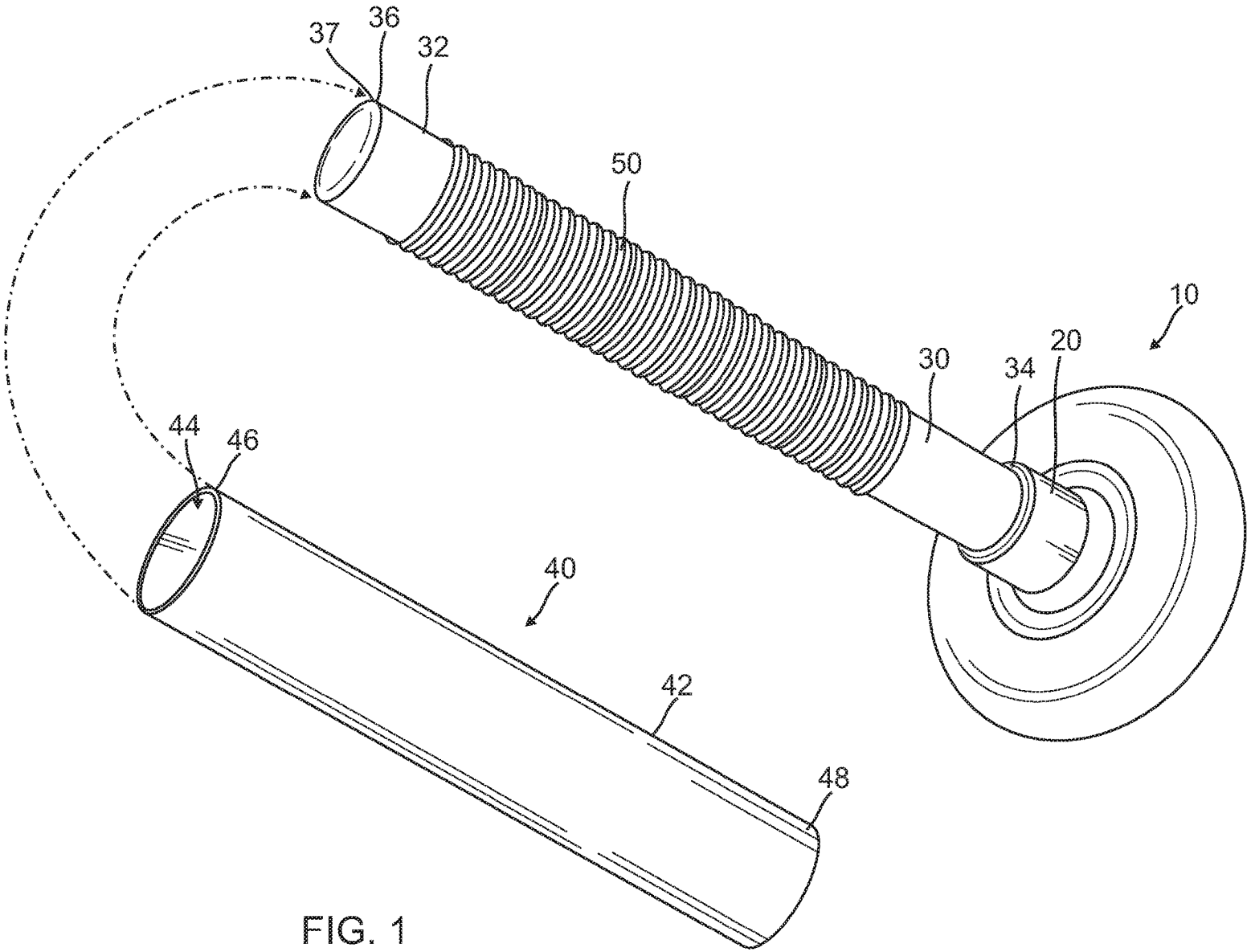
FIG. 1 is an exploded view illustrating a roller with a collar retaining a metal shaft extending from the roller and the present invention threads formed into the metal roller shaft and the plastic tube about to be inserted and threaded onto the shaft of the roller.

Referring to FIG. 1, there is illustrated a perspective view which includes a conventional roller wheel 10 which is placed into a track of a garage door so that a garage door can be rolled up and down with a pair of oppositely disposed rollers respectively set within oppositely disposed tracks adjacent opposite ends of the garage door. The roller wheel 10 includes a collar 20 with the metal roller shaft 30 retained into the roller wheel 10 by the collar 20. The innovation of the present invention is to retain a plastic tube or tire 40 made out of material as described above selected from the group consisting of hard thermoplastic (such as Delrin®), urethane (PER) durable synthetic plastics. The plastic tube or tire 40 has a cylindrical outer wall 42 and a cylindrical inner chamber 44 surrounded by the cylindrical outer wall 42 and open at both a first end 46 and a second end 48. A tube retaining member 50 is formed into the outer cylindrical wall 42 of the metal roller shaft 30. As illustrated in FIG. 1, the retaining member 50 is selected from the group consisting of treads, threads or screw threads are cut or otherwise formed into the outer wall 32 of metal roller shaft 30. The plastic tube 40 is injection molded on the metal roller shaft 30 and press molded against the threads 60 and is thereby securely retained on the metal roller shaft 30.

Figure 2:
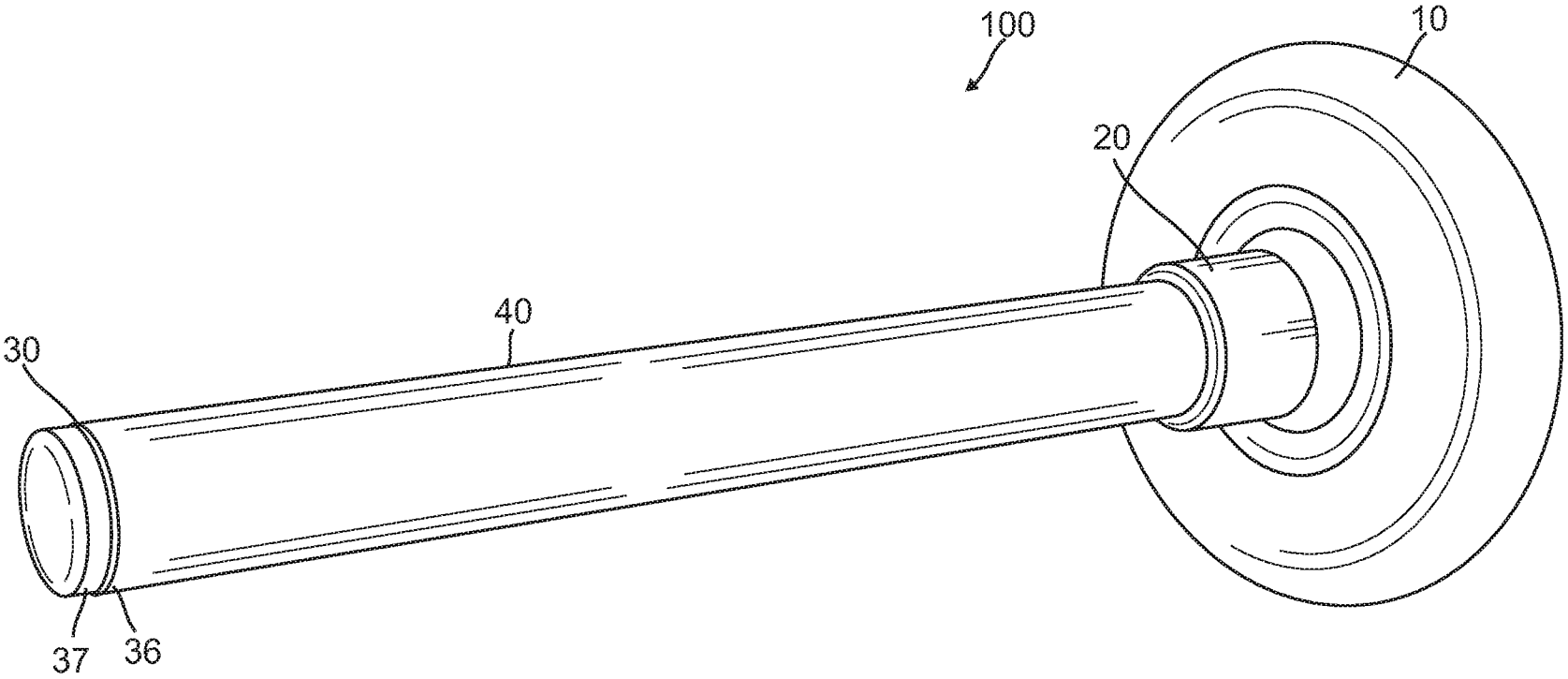
FIG. 2 is a perspective view of the roller shown with the plastic injection molded tube encircling the metal roller shaft and having been threaded onto the metal shaft of the roller through the threads on the metal shaft which are part of the present invention.

Referring to FIG. 2, there is illustrated a perspective view of the completed present invention roller wheel assembly 100 which includes the roller wheel 10, the injection molded plastic tube 40 encircling the metal roller shaft 30 retained at a first end 34 through the collar 20 and into the roller wheel 10, the plastic tube 40 having been injection molded onto or press fit onto the metal roller shaft 30. A detent 37 is at the second end 36 of the metal roller shaft 30 to be crimped or have a retention member thereon to prevent the metal roller shaft from sliding out of the brackets of the hinge member (See FIG. 6).

Figure 3:
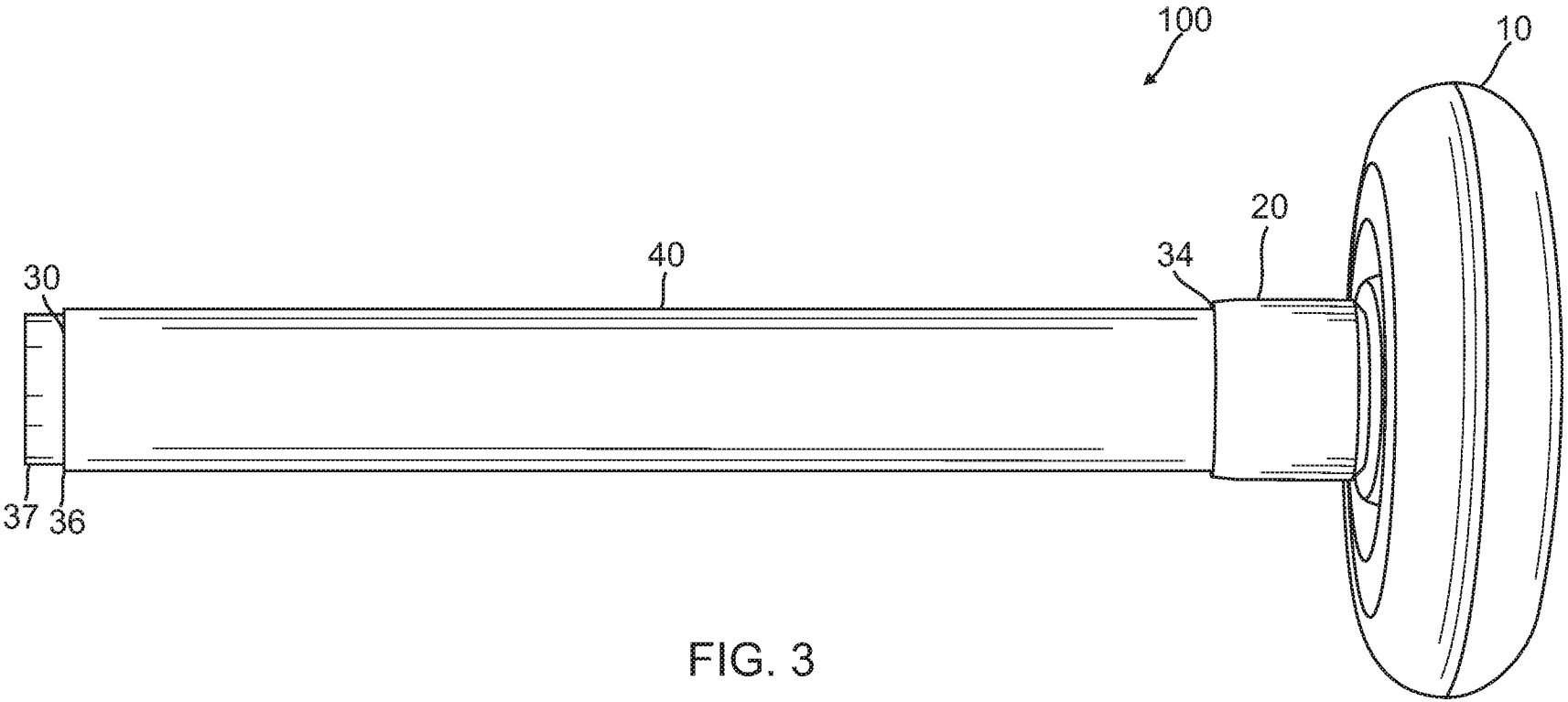
FIG. 3 is a side view of the roller shown with the plastic injection molded tube encircling the metal roller shaft and having been threaded onto the metal shaft of the roller through the threads on the metal shaft which are part of the present invention.

Referring to FIG. 3, there is illustrated a perspective view of the completed present invention roller wheel assembly 100 which includes the roller wheel 10, the injection molded plastic tube 40 encircling the metal roller shaft 30 retained at a first end 34 through the collar 20 and into the roller wheel 10, the plastic tube 40 having been molded onto or press fit onto the metal roller shaft 30. A detent 37 is at the second end 36 of the metal roller shaft 30 to be crimped or have a retention member thereon to prevent the metal roller shaft from, sliding out of the brackets of the hinge member (See FIG. 6).

Figure 4:
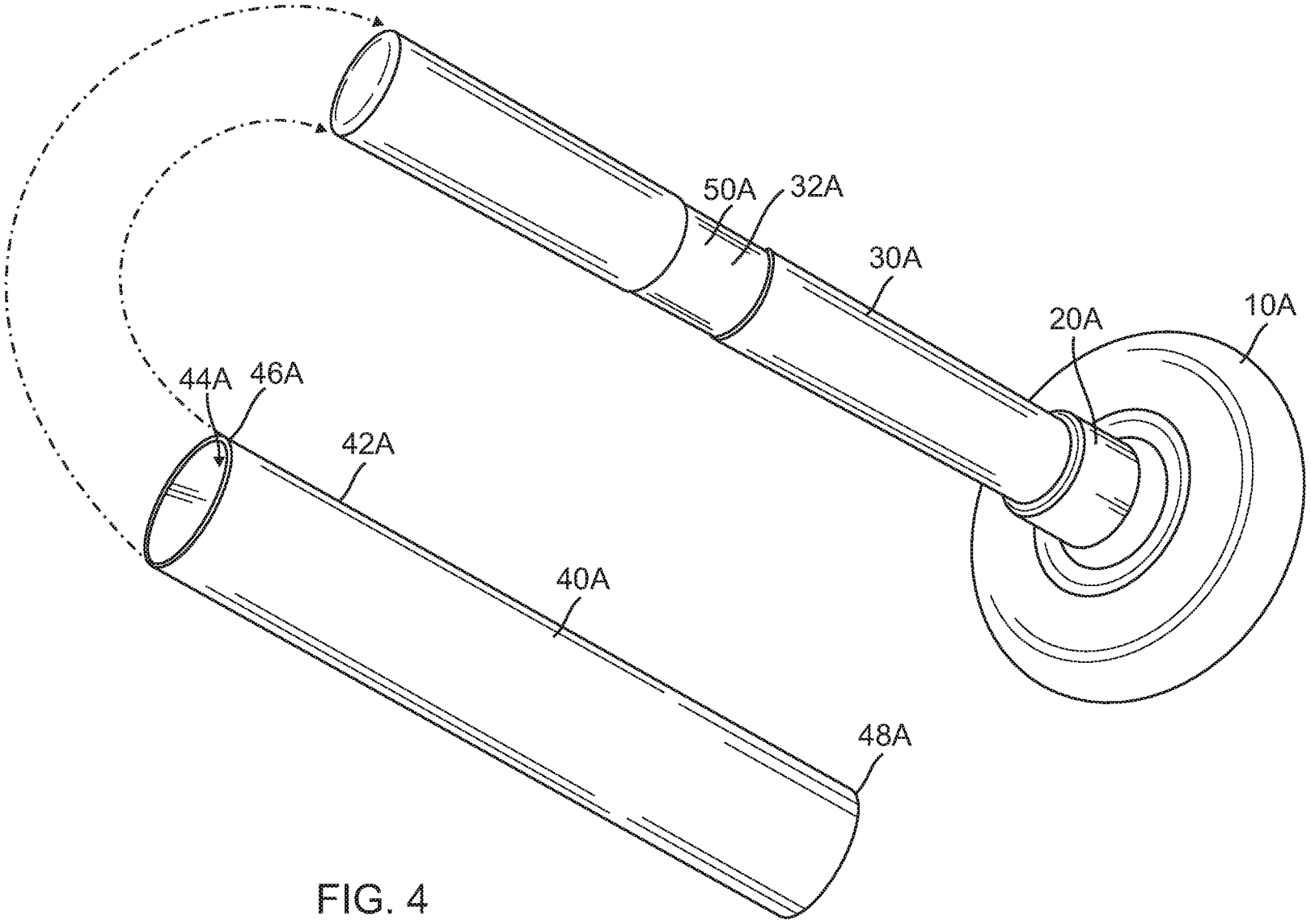
FIG. 4 is an exploded view of the shaft extending from the roller with a locking member within the shaft and a plastic tube to be inserted onto the shaft of the roller.

Referring to FIG. 4, there is illustrated a perspective view of an alternative embodiment of the present invention which includes a roller wheel 10A which is placed into a track of a garage door so that a garage door can be rolled up and down with a pair of oppositely disposed rollers respectively set within oppositely disposed tracks adjacent opposite ends of the garage door. The roller wheel 10A includes a collar 20A with the metal roller shaft 30A retained into the roller wheel 10A by the collar 20A. The innovation of the present invention is to retain a plastic tube or tire 40A made out of material as described above selected from the group consisting of hard thermoplastic (such as Delrin®), urethane (PER) durable synthetic plastics. The plastic tube or tire 40A has a cylindrical outer wall 42A and a cylindrical inner chamber 44A surrounded by the cylindrical outer wall 42A and open at both a first end 46A and a second end 48A. A tube retaining member 50A is formed into the outer cylindrical wall 32A of the metal roller shaft 30A. As illustrated in FIG. 4, detents or at least one locking member 37A (see FIG. 5) are cut or otherwise formed into the outer wall 32A of metal roller shaft 30A. The plastic tube 40A is injection molded onto the metal roller shaft 30A and retained thereon by the at least one locking member 37A so that the plastic tube 40A is securely retained on the metal roller shaft 30A.

Figure 5:
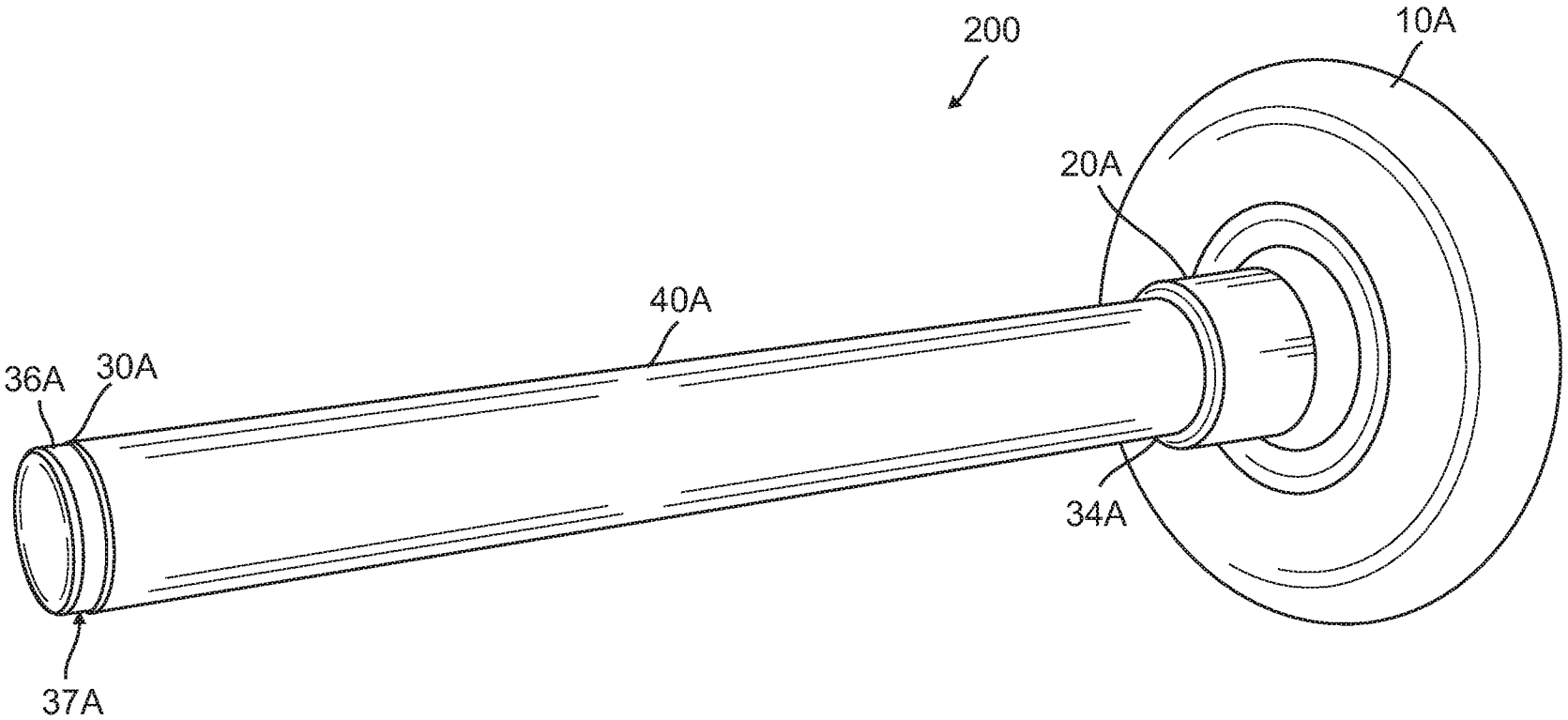
FIG. 5 is a top view of the completed embodiment of the plastic tube affixed onto the metal roller shaft.

Referring to FIG. 5, there is illustrated a perspective view of the completed alternative embodiment of the present invention roller wheel assembly 200 which includes the roller wheel 10A, the plastic tube 40A encircling the metal roller shaft 30A retained at a first end 34A through the collar 20A and into the roller wheel 10A, the plastic tube 40A having been retained onto the metal roller shaft 30A. A detent 37A is at the second end 36A of the metal roller shaft 30A to be crimped or have a retention member thereon to prevent the metal roller shaft from sliding out of the brackets of the hinge member (See FIG. 6).

Figure 6:
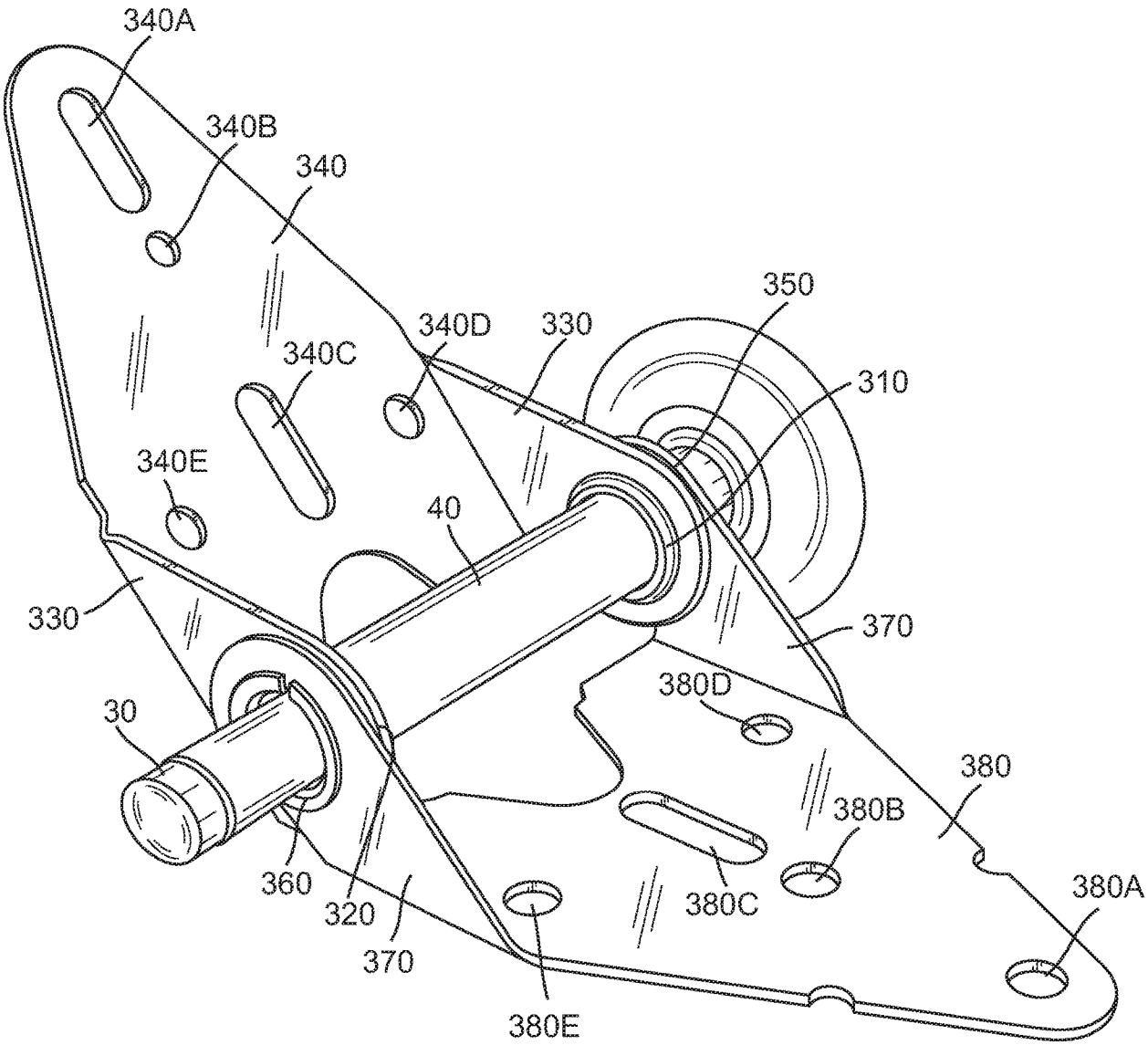
FIG. 6 is a perspective view of the new and improved rolled plastic lined metal roller shaft affixed through openings in the hinge plate which affixes the assembly to the back of a garage door which enables the track roller to roll up and down the track and eliminates the noise between the metal roller shaft and the metal portions of the hinge plate due to the fact that the shaft of the roller is now covered with plastic which is affixed onto the shaft of the roller so that the plastic shaft reduces noise and assure that the plastic shaft will not roll or fall off the shaft of the roller.

Referring to FIG. 6, there is illustrated a perspective view of the new and improved plastic lined metal roller shaft 30 affixed through openings 310 and 320 in hinge bracket 330 affixed to first hinge plate 340 and openings 350 and 360 in hinge bracket 370 affixed to hinge plate 380. First hinge plate 340 has a multiplicity of openings 340A, 340B, 340C, 340D, and 340E through which fastening members affix first hinge plate 340 to the back of a garage door panel. Second hinge plate 380 has a multiplicity of openings 380A, 340B, 340C, 380D, and 380E through which fastening members affix second hinge plate 380 to the back of a garage door panel. The hinge plates 340 and 380 are respectively affixed at the location of two adjacent garage door panels which enables the roller wheel 10 to roll up and down a track (with an opposite roller wheel inside an opposite track) to enable the garage door to move up and down.

The plastic tube 40 covering the metal roller shaft 30 eliminates metal to metal contact between the metal roller shaft 30 and the metal brackets 330 and 370 and metal hinge plates 340 and 380 to thereby significantly reduce the noise between the metal roller shaft 30 and the metal portions of the hinge brackets and hinge plates of the hinge as the garage moves is moved upward and downwards.

The metal roller shaft can be covered with a plastic tube such as 40 or 40A and retained on the metal roller shaft 30 by retaining members such as treads, threads, screw threads, detents or other locking members. The metal roller shaft can also be coated with plastic and also the plastic can be heat formed or molded onto the metal roller shaft 30. The plastic covering also creates a tight press fit with the openings 310, 320, 350 and 360 with the hinge brackets 330 and 370 respectively affixed to hinge plates 340 and 380 to further reduce noise and assure that the plastic shaft will not roll or fall out of the hinge brackets 330 and 370. The plastic coating on the metal roller shaft causing the plastic to abut against the openings 330, 320, 350 and 360 and therefore, the rattling noise of metal-to-metal contact known in the prior art is eliminated so that there is a much quieter action of the garage door roller as it rolls up and down the garage door track.

Figure 7A:
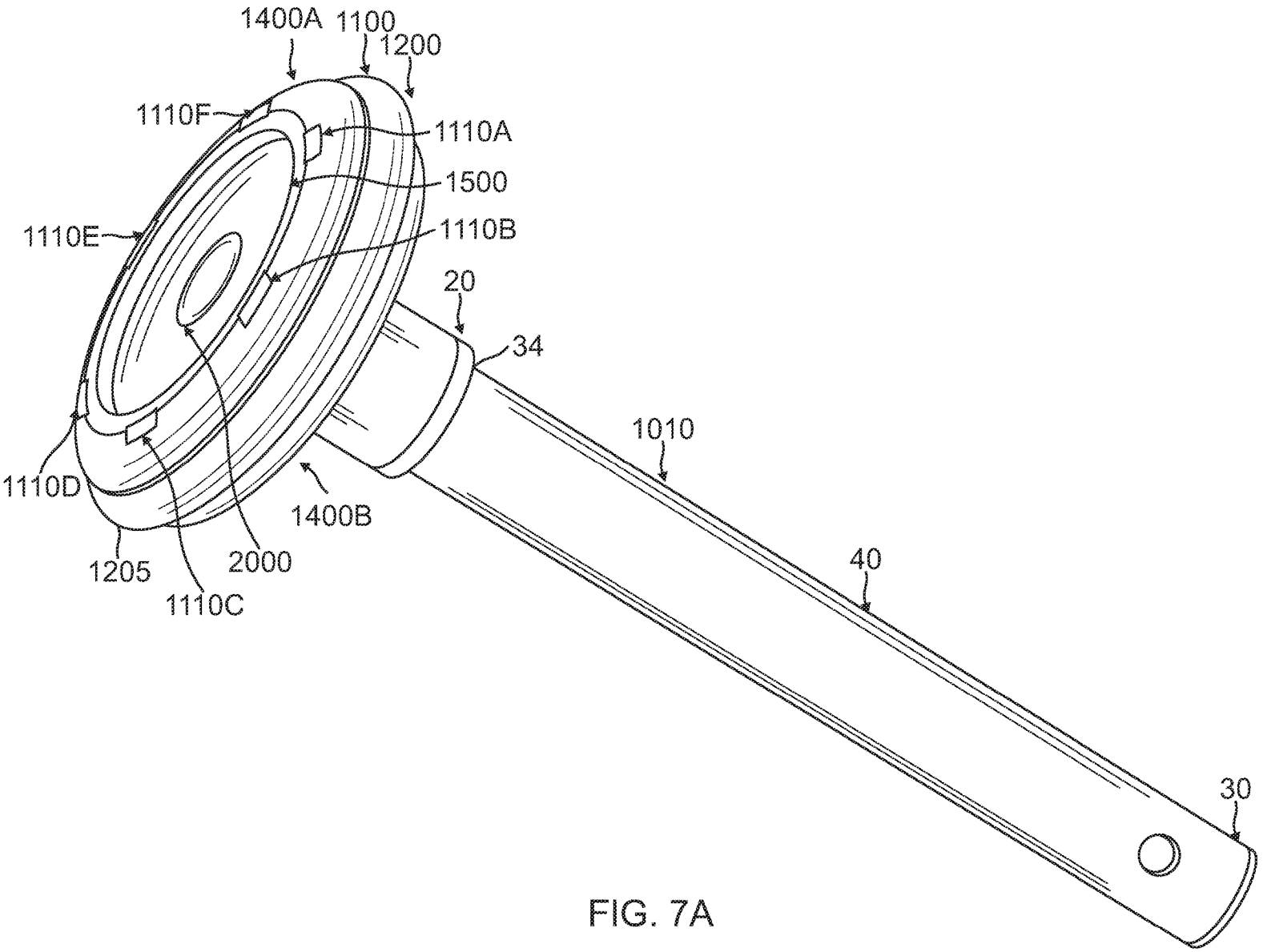
FIG. 7A is a front perspective view of a second embodiment of the roller wheel in the present invention with the two sections of the wheel retained together by urethane (PER)
Figure 7B:
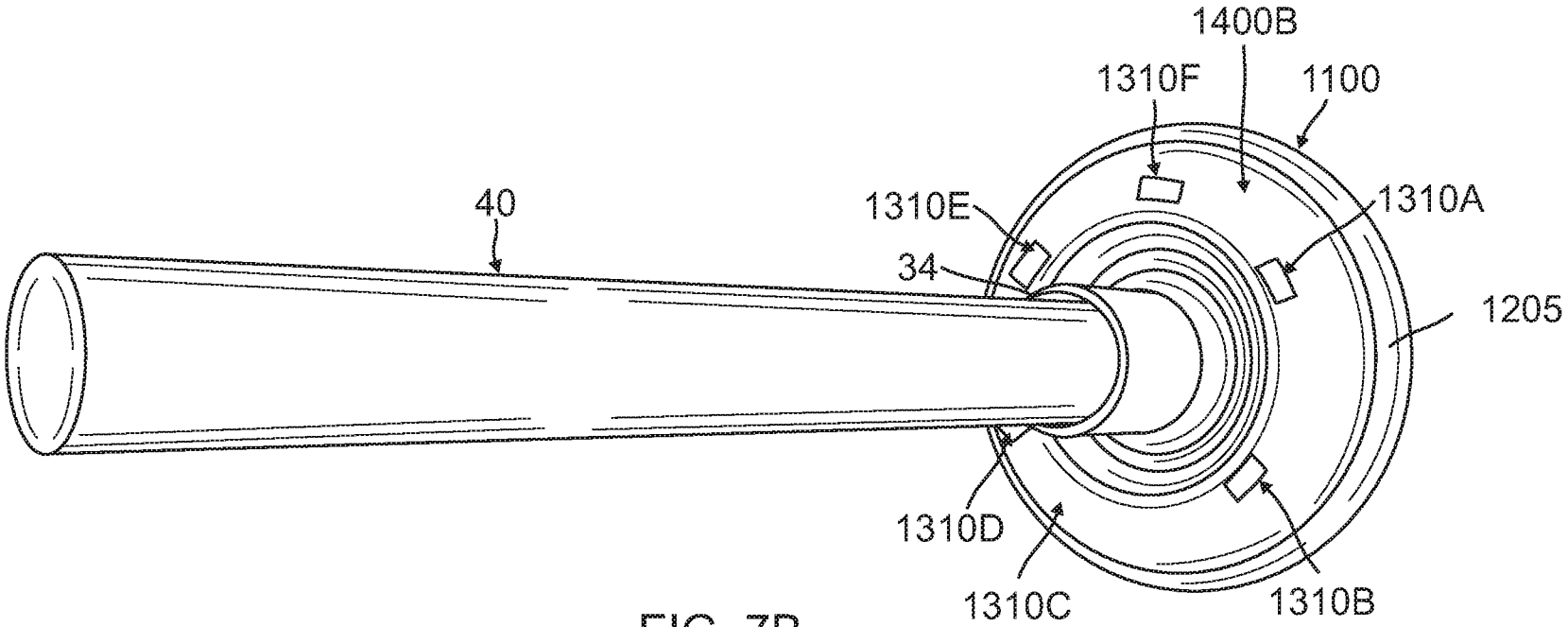
FIG. 7B is a rear perspective view of a second embodiment of the roller wheel in the present invention with the two sections of the wheel retained together by urethane (PER)

The present invention addresses a second problem that noise also comes from wheel rolling in the garage door track. Referring to FIGS. 7A, 7B, 8, 9A and 9B there is illustrated a second embodiment roller wheel assembly 1010, similar to the first embodiment 100, the injection molded plastic tube 40 encircling the metal roller shaft 30 is retained at a first end 34 through the collar 20. The second embodiment roller wheel assembly 1010 differs from the first embodiment by the use of a urethane (PER) central tire 1100 (illustrated in FIGS. 7A and 7B) which is injected into a central gap 1250 (see FIGS. 9A and 9B) between wheel section 1400A and 1400B (see FIGS. 9A and 9B) to form the present invention urethane tire 1200 as illustrated in FIGS. 7A and 7B.

Figure 8:
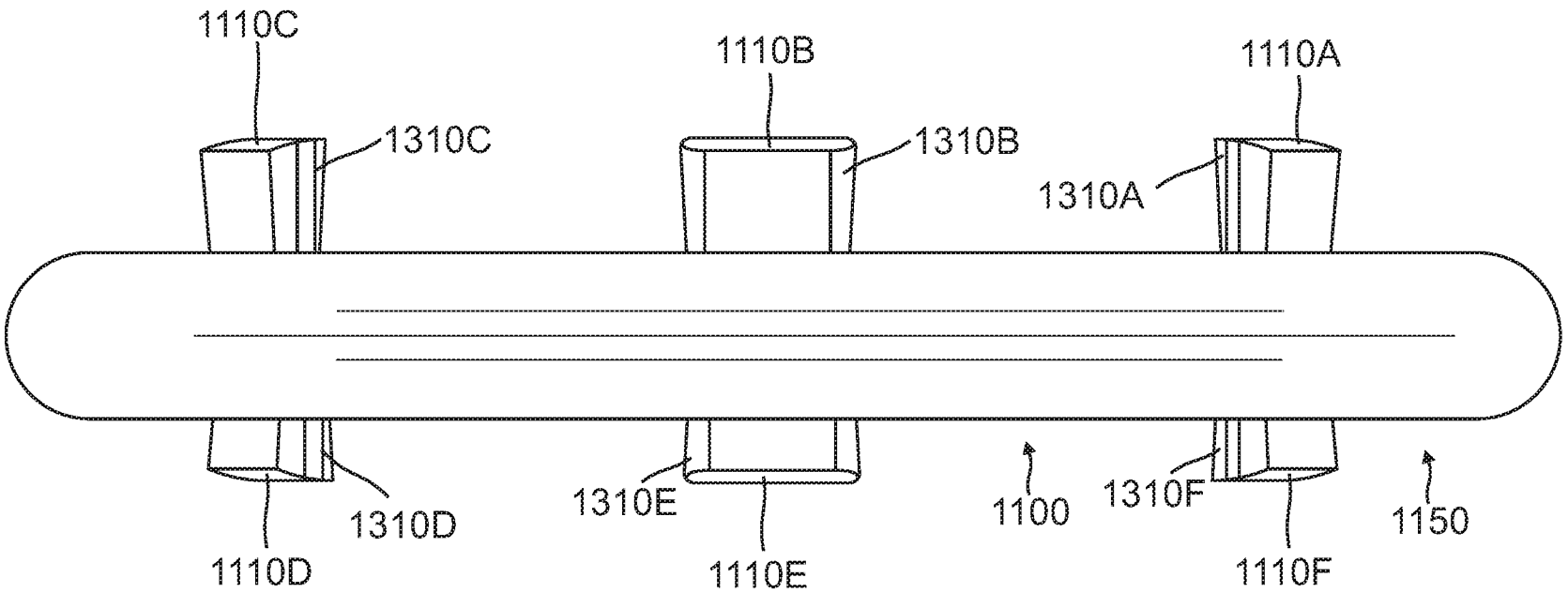
FIG. 8 is a side perspective view of only the urethane (PER) portion of the wheel that is in the gap between two wheel sections and extends through the openings of the two sections.

Referring to FIG. 8, there is illustrated the central section 1100 which is made of material selected from the group consisting of urethane and polyurethane (PER) (jointly and severally referred to throughout as "urethane (PER)"). The central section 1100 is entirely comprised of urethane PER and the shape of the urethane (PER) central tire wheel section 1100 illustrated in FIGS. 7A, 7B and 8 illustrates the remaining conceptual portion of the urethane (PER) central tire sections illustrating several protruding urethane (PER) sections which flow into openings or polyoxymethylene (POM) gaps in respective wheel sections 1400A and 1400B. The protruding urethane (PER) sections are for illustration and not limitation purposes. The central tire wheel section 1100 illustrated in FIGS. 7A and 7B corresponds to the shape that fits into central gap 1250 located between the two integrally formed wheel sections 1400A and 1400B (illustrated in FIGS. 9A and 9B) to form a tire after it has hardened. Integrally formed wheel section 1400A has an outer circumferential surface 1400A-ES and integrally formed wheel section 1400B has an outer circumferential surface 1400B-ES Integrally formed sections 1400A and 1400B are typically made of (POM), also known as acetal, polyacetal and polyformaldehyde. POM is typically a hard plastic that is characterized by hardness and high strength. It is also within the spirit and scope of the present invention for two integrally formed POM sections to be made of thermoplastics.

Figure 9A:
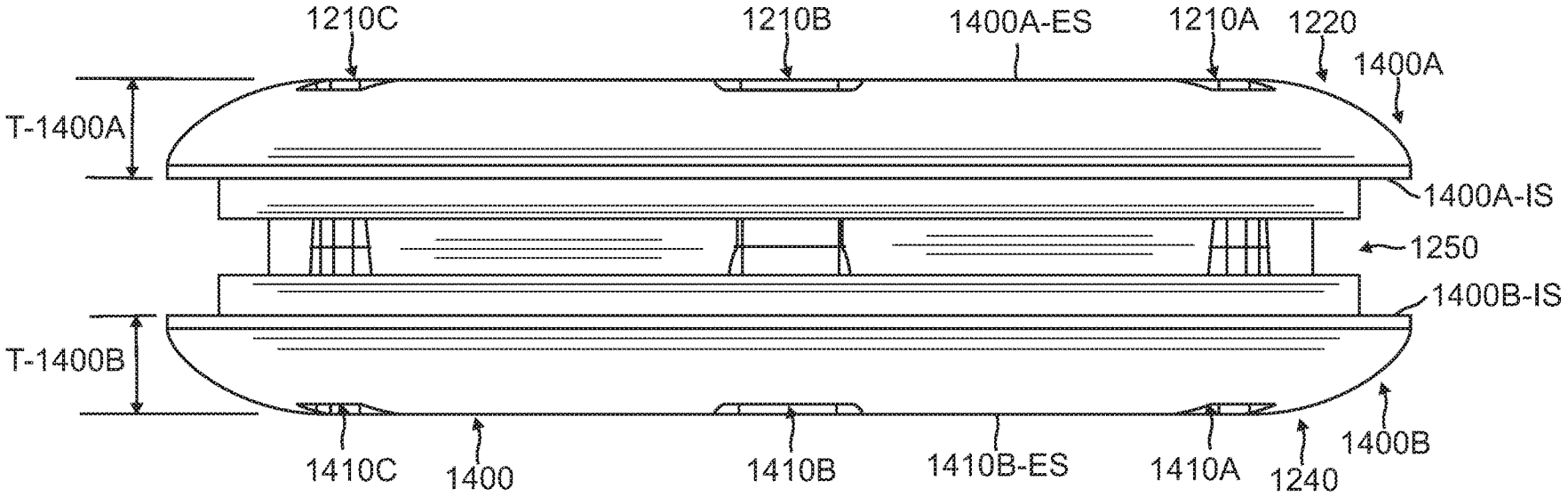
FIG. 9A is a left side perspective view of only the two section of the wheel prior to the urethane (PER) portion being added.
Figure 9B:
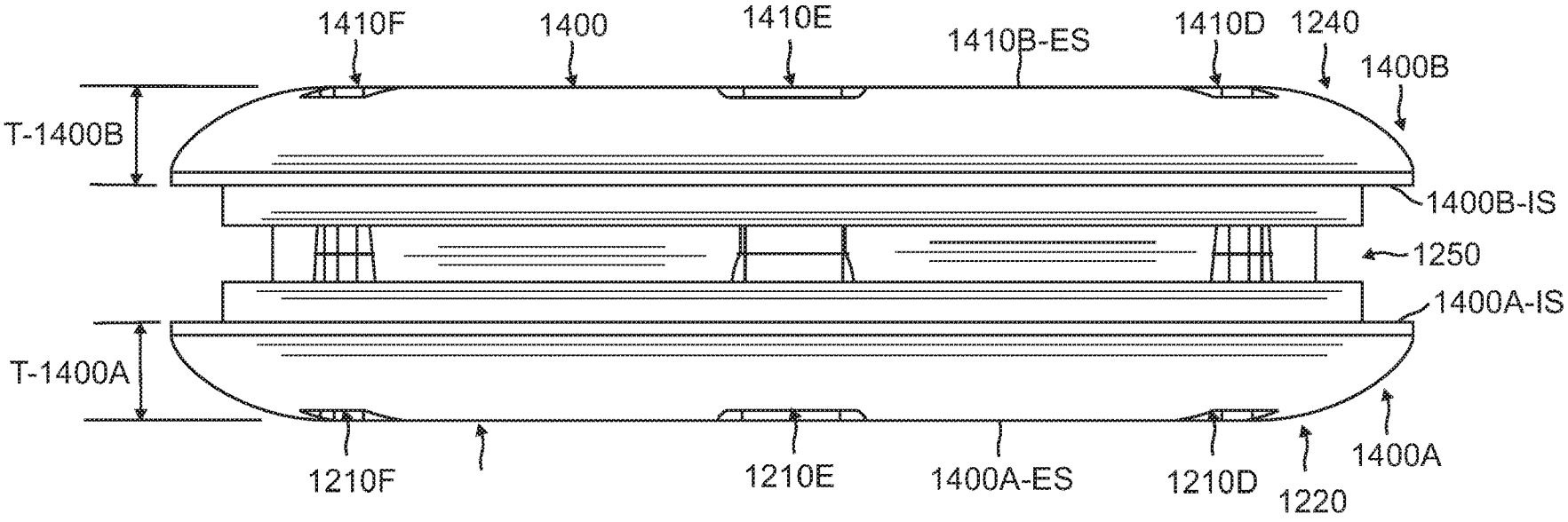
FIG. 9B is a right side perspective view of only the two section of the wheel prior to the urethane (PER) portion being added.

FIG. 7A is a front perspective view of a second embodiment of the roller wheel in the present invention with the two sections of the wheel retained together by urethane (PER). FIG. 7B is a rear perspective view of a second embodiment of the roller wheel in the present invention with the two sections of the wheel retained together by urethane (PER). FIG. 9A is a left side perspective view of only the two section of the wheel prior to the urethane (PER) portion being added. FIG. 9B is a right side perspective view of only the two section of the wheel prior to the urethane (PER) portion being added.

FIGS. 9A and 9B illustrate the two POM sections 1400A and 1400B before injection of polyurethane, FIG. 8 illustrates what the injected polyurethane would look like after injection if there were no sections 1400A and 1400B. FIGS. 7A and 7B illustrate the complete present invention wheel after the polyurethane injection.

During the creation of the present invention polyurethane roller wheel 1200 which is comprised of urethane (PER) section 1100 and the two integrally formed wheel sections 1400A and 1400B, liquid polyurethane is injected into central gap 1250 and then the liquid polyurethane flows from POM central gap 1250 into POM gaps 1210A, 1210B, 1210C, 1210D, 1210E, and 1210F in first wheel section 1400A as illustrated in FIGS. 9A and 9B. In addition, when liquid polyurethane is injected into central gap 1250, then the liquid polyurethane flows from POM central gap 1250 into POM gaps 1410A, 1410B, 1410C, 1410D, 1410E, and 1410F in second wheel section 1400B as illustrated in FIGS. 9A and 9B. A portion of a gap is running through the entire transverse thickness of each respective POM section.

Referring to FIGS. 9A and 9B, first wheel section or POM section 1400A has an exterior surface 1400A-ES and an interior surface 1400A-IS and a thickness T-1400A. Referring to FIGS. 9A and 9B, second wheel section or POM section 1400B has an exterior surface 1400B-ES and an interior surface 1400B-IS and a thickness T-1400B. While each wheel section is shown with six (6) holes, openings, POM gaps or synonymous terms, six (6) is an arbitrary number and any number of holes from at least two (2) in each wheel section 1400A and 1400B is within the spirit and scope of the present invention.

Referring to FIG. 8, urethane (PER) section 1100 can be divided into the PER central section 1150 which fits into central gap 1250 and twelve (12) protruding sections Protruding sections 1110A, 1110B, 1110C, 1110D, 1110E, and 1110F respectively fit into POM gaps 1210A, 1210B, 1210C, 1210D, 1210E, and 1210F. Protruding sections 1310A, 1310B, 1310C, 1310D, 1310E, and 1310F respectively fit into POM gaps 1410A, 1410B, 1410C, 1410D, 1410E, and 1410F. In FIGS. 7A and 7B, the protruding polyurethane sections are visible in each respective gap. Therefore, the protruding polyurethane sections are illustrated and numbered in FIGS. 7A and 7B and the POM gaps are illustrated and numbered in FIGS. 9A and 9B.

Figure 10:
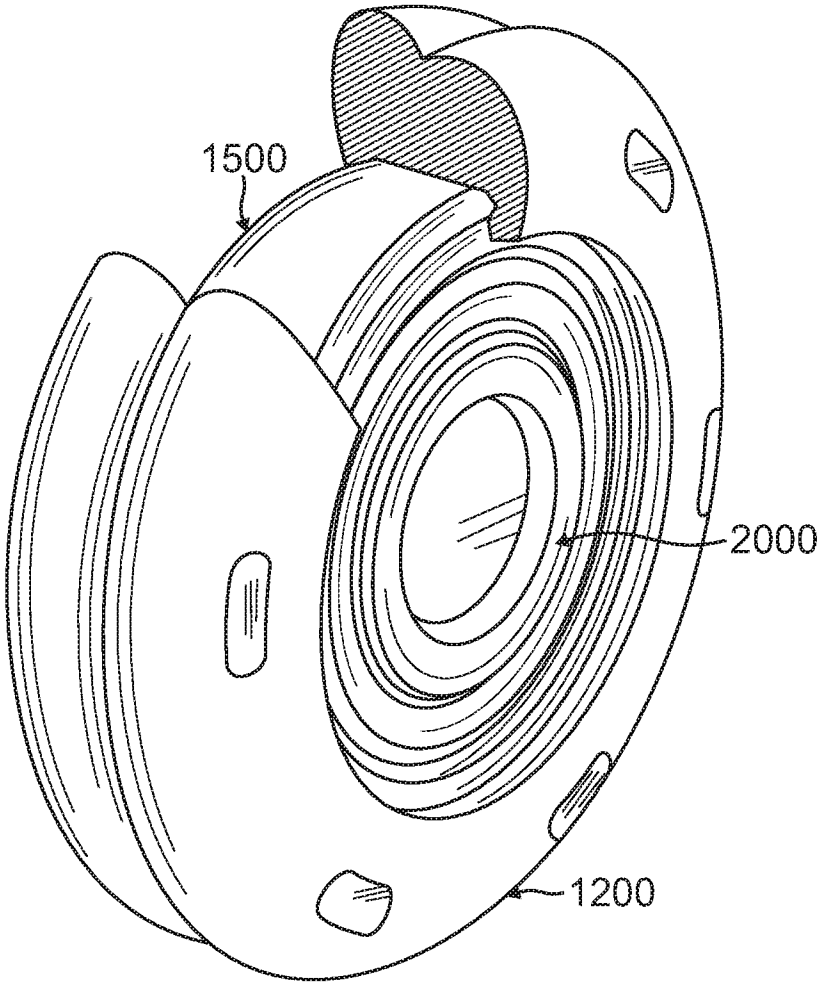
FIG. 10 is a front side perspective view of the present invention urethane wheel 1200 with all of the urethane (PER) removed and a portion of the two integrally formed polyoxymethylene (POM) sections 1400A and 1400B removed to illustrate the metal separator and ball bearing assembly.

Referring to FIG. 10, there is illustrated a front side perspective view of the present invention polyurethane roller wheel 1200 with all of the urethane (PER) removed and a portion of the two integrally formed POM sections 1400A and 1400B removed. Referring to FIG. 10, there is illustrated the metal separator 1500 and ball bearing assembly 2000. Ball bearing assembly 2000 is located at the center of the present invention polyurethane roller wheel 1200. Ball bearing assembly 2000 may consist of five (5) to eleven (11) ball bearings. There is a circular metal separator 1500 that connects ball bearing assembly 2000 to POM sections 1400A and 1400B.

Referring to FIGS. 7A, 7B and 10, when the urethane (PER) section 1100 of the present invention polyurethane roller wheel 1200 has been injected into POM gaps 1210A, 1210B, 1210C, 1210D, 1210E, and 1210F and 1410A, 1410B, 1410C, 1410D, 1410E, and 1410F and allowed to harden, the resulting polyurethane roller wheel 1200 has a tire edge 1205 that is wearable item that will wear down during continued use as a car tire would. The present invention polyurethane roller wheel 1200 could then be re-injected with more of the polyurethane to restore the polyurethane roller wheel 1200 having a tire edge 1205 or it can be replaced. During the time the urethane (PER) section 1100 has worn down, the wheel will still function; however, an increase in noise will be experienced based upon the interaction of the hard plastic with the garage door track as opposed to the polyurethane section being in direct contact with the garage door track.

The present invention polyurethane roller wheel 1200 is typically 2 inches and the urethane (PER) section 1100 is approximately ⅛ of an inch beyond that. The range of the diameter would therefore be 2 inches plus 1/16 inch for the polyurethane section (PUR) or tire wheel 1100 and could be up to ¼ inch. Therefore, the diameter of the polyurethane wheel 1100 typically ranges from 2 and 1/16 inches to 2¼ inch with the preferred diameter being 2 and ⅛ inches. It is within the spirit and scope of this invention though for the dimensions of the present invention polyurethane roller wheel 1200 to be larger or smaller than the typically dimensions and range given.

Of course the present invention is not intended to be restricted to any particular form or arrangement, or any specific embodiment, or any specific use, disclosed herein, since the same may be modified in various particulars or relations without departing from the spirit or scope of the claimed invention herein above shown and described of which the apparatus or method shown is intended only for illustration and disclosure of an operative embodiment and not to show all of the various forms or modifications in which this invention might be embodied or operated.

What is claimed is:

1. A garage door roller assembly comprising:

a hinge configured for use with two adjacent garage door panels of a garage door, a roller wheel rollable within a garage door track adjacent an exterior edge of each of the two adjacent garage door panels;

a cylindrical metal shaft affixed to the roller wheel and extending perpendicular to the roller wheel, the cylindrical metal shaft adapted for use with the hinge;

wherein the hinge comprises:

a first hinge plate affixed to a first hinge bracket made of metal having parallel oppositely disposed metal openings through the first hinge bracket made of metal;

a second hinge plate affixed to a second hinge bracket made of metal having parallel oppositely disposed metal openings through the second hinge bracket made of metal;

the second hinge bracket made of metal exterior to the first hinge bracket made of metal, wherein the parallel oppositely disposed openings in the second hinge bracket made of metal are respectively aligned with, exterior to and adjacent to respective ones of the parallel oppositely disposed openings in the first hinge bracket made of metal;

the first hinge plate affixed to a back of a first of said two adjacent garage door panels;

the second hinge plate affixed to a back of a second of said two adjacent garage door panels;

the cylindrical metal shaft having an outer wall having a diameter, a tube retaining member incorporated with at least a portion of the outer cylindrical wall of the cylindrical metal shaft;

an exterior plastic material selected from the group consisting of polyurethane and synthetic plastic formed onto at least a portion of the tube retaining member to form a combination exterior plastic tube and cylindrical metal shaft with the exterior plastic tube having an exterior surface having a diameter;

the combination exterior plastic tube and cylindrical metal shaft inserted through one of the openings in the second hinge bracket made of metal, through an adjacent one of the aligned openings in the first hinge bracket made of metal, through another one of the openings in the first hinge bracket made of metal and through an adjacent one of the aligned openings in the second hinge bracket made of metal with no metal retaining member between the combination exterior plastic tube and cylindrical metal shaft and the aligned openings in the first and second hinge brackets made of metal so that the exterior plastic tube covers the cylindrical metal shaft at the locations of and between the aligned openings in the second hinge bracket made of metal and adjacent first hinge bracket made of metal and another first hinge bracket made of metal and adjacent another second hinge bracket made of metal, a portion of the cylindrical metal shaft not covered by the exterior plastic tube having the outer cylindrical surface retained at one end of the cylindrical metal shaft through the roller wheel and after insertion of the combination exterior plastic tube and cylindrical metal shaft through one of the openings in the second hinge bracket made of metal, through an adjacent one of the aligned openings in the first hinge bracket made of metal, through another one of the openings in the first hinge bracket made of metal and through an adjacent one of the aligned openings in the second hinge bracket made of metal, an opposite end of the cylindrical metal shaft also not covered by the exterior plastic tube; and wherein the diameter of the exterior surface of the plastic tube is greater than the diameter of the outer wall of the cylindrical metal shaft, each of the aligned openings in the first hinge bracket made of metal and the second hinge bracket made of metal having a diameter larger than the diameter of the exterior surface of the plastic tube of the combination plastic tube and cylindrical metal shaft;

wherein, the combination plastic tube and cylindrical metal shaft prevents metal-to-metal contact between the outer wall of the cylindrical metal shaft and the first hinge bracket made of metal and the second hinge bracket made of metal; and wherein the roller wheel comprises:

two integrally formed wheel halves, each of the wheel halves comprising a plurality of holes formed therethrough;

a gap between the two wheel halves;

a ball bearing assembly;

a circular metal separator connecting the ball bearing assembly to each of the two wheel halves; and a tire made of material selected from the group consisting of urethane and urethane (PER), the tire positioned within the gap for retaining the two wheel halves together, wherein the tire comprises a central section and a plurality of protruding sections that extend from the central section and through the plurality of holes formed in the wheel halves and wherein the tire has a diameter larger than a diameter of each of the wheel halves.

2. The garage door roller assembly of claim 1, wherein each of the two wheel halves is made of polyoxymethylene.

3. The garage door roller assembly of claim 1, wherein the tire directly contacts the garage door track.

4. The garage door roller assembly of claim 1, wherein the roller wheel has a diameter between 1.5 inches and 2.5 inches.

5. A noise reducing roller wheel assembly for use with a garage door comprising:

a roller wheel rollable within a garage door track adjacent an exterior edge of two adjacent garage door panels, the roller wheel comprising:

two integrally formed wheel halves, each of the wheel halves comprising a plurality of holes formed therethrough;

a gap between the two wheel halves;

a ball bearing assembly;

a circular metal separator connecting the ball bearing assembly to each of the two wheel halves; and a urethane tire positioned within the gap for retaining the two wheel halves together, wherein the urethane tire comprises a central section and a plurality of protruding urethane sections that extend from the central section and through the plurality of holes formed in the wheel halves and wherein the urethane tire has a diameter larger than a diameter of each of the wheel halves;

a cylindrical metal shaft affixed to a collar of the roller wheel and extending perpendicular to the collar of the roller wheel; and a hinge configured for use with the two adjacent garage door panels of the garage door, the hinge comprising:

a first hinge plate affixed to a first hinge bracket made of metal having parallel oppositely disposed metal openings through the first hinge bracket made of metal;

a second hinge plate affixed to a second hinge bracket made of metal having parallel oppositely disposed metal openings through the second hinge bracket made of metal;

the second hinge bracket made of metal exterior to the first hinge bracket made of metal, wherein the parallel oppositely disposed openings in the second hinge bracket made of metal are respectively aligned with, exterior to and adjacent to respective ones of the parallel oppositely disposed openings in the first hinge bracket made of metal;

the first hinge plate affixed to a back of a first of said two adjacent garage door panels;

the second hinge plate affixed to a back of a second of said two adjacent garage door panels;

the cylindrical metal shaft having an outer wall having a diameter, a tube retaining member incorporated with at least a portion of the outer cylindrical wall of the cylindrical metal shaft;

an exterior plastic material selected from the group consisting of polyurethane and synthetic plastic formed onto at least a portion of the tube retaining member to form a combination exterior plastic tube and cylindrical metal shaft with the exterior plastic tube having an exterior surface having a diameter;

the combination exterior plastic tube and cylindrical metal shaft inserted through one of the openings in the second hinge bracket made of metal, through an adjacent one of the aligned openings in the first hinge bracket made of metal, through another one of the openings in the first hinge bracket made of metal and through an adjacent one of the aligned openings in the second hinge bracket made of metal with no metal retaining member between the combination exterior plastic tube and cylindrical metal shaft and the aligned openings in the first and second hinge brackets made of metal so that the exterior plastic tube covers the cylindrical metal shaft at the locations of and between the aligned openings in the second hinge bracket made of metal and adjacent first hinge bracket made of metal and another first hinge bracket made of metal and adjacent another second hinge bracket made of metal, a portion of the cylindrical metal shaft not covered by the exterior plastic tube having the outer cylindrical surface retained at one end of the cylindrical metal shaft through the collar of the roller wheel and after insertion of the combination exterior plastic tube and cylindrical metal shaft through one of the openings in the second hinge bracket made of metal, through an adjacent one of the aligned openings in the first hinge bracket made of metal, through another one of the openings in the first hinge bracket made of metal and through an adjacent one of the aligned openings in the second hinge bracket made of metal, an opposite end of the cylindrical metal shaft also not covered by the exterior plastic tube; and wherein the diameter of the exterior surface of the plastic tube is greater than the diameter of the outer wall of the cylindrical metal shaft, each of the aligned openings in the first hinge bracket made of metal and the second hinge bracket made of metal having a diameter larger than the diameter of the exterior surface of the plastic tube of the combination plastic tube and cylindrical metal shaft;

wherein, the combination plastic tube and cylindrical metal shaft prevents metal-to-metal contact between the outer wall of the cylindrical metal shaft and the first hinge bracket made of metal and the second hinge bracket made of metal.

6. The noise reducing roller assembly of claim 5, wherein each of the two wheel halves is made of polyoxymethylene.

7. The noise reducing roller wheel assembly of claim 5, wherein the urethane tire directly contacts the garage door track.

8. The noise reducing roller wheel assembly of claim 5, wherein the roller wheel has a diameter between 1.5 inches and 2.5 inches.

9. A noise reducing roller wheel assembly for use with a garage door comprising:

a roller wheel rollable within a garage door track adjacent an exterior edge of two adjacent garage door panels, the roller wheel comprising:

a first wheel section and a second wheel section, the first wheel section and the second wheel section being integrally formed;

a first plurality of holes formed through a thickness of the first wheel section;

a second plurality of holes formed through a thickness of the second wheel section;

a gap between the first wheel section and the second wheel section;

a ball bearing assembly;

a circular metal separator connecting the ball bearing assembly to each of the first wheel section and the second wheel section; and a tire made of material selected from the group consisting of urethane and urethane (PER), the tire positioned within the gap for retaining the first wheel section and the second wheel section together, the tire comprising:

a central section;

a first plurality of protruding sections that extend from the central section and through the first plurality of holes formed through the thickness of the first wheel section;

a second plurality of protruding sections that extend from the central section and through the second plurality of holes formed through the thickness of the second wheel section;

wherein the tire has a diameter larger than a diameter of each of the wheel halves;

a cylindrical metal shaft affixed to the roller wheel and extending perpendicular to the roller wheel; and a hinge configured for use with the two adjacent garage door panels of the garage door, the hinge comprising:

a first hinge plate affixed to a first hinge bracket made of metal having parallel oppositely disposed metal openings through the first hinge bracket made of metal;

a second hinge plate affixed to a second hinge bracket made of metal having parallel oppositely disposed metal openings through the second hinge bracket made of metal;

the second hinge bracket made of metal exterior to the first hinge bracket made of metal, wherein the parallel oppositely disposed openings in the second hinge bracket made of metal are respectively aligned with, exterior to and adjacent to respective ones of the parallel oppositely disposed openings in the first hinge bracket made of metal;

the first hinge plate affixed to a back of a first of said two adjacent garage door panels;

the second hinge plate affixed to a back of a second of said two adjacent garage door panels;

the cylindrical metal shaft having an outer wall having a diameter, a tube retaining member incorporated with at least a portion of the outer cylindrical wall of the cylindrical metal shaft;

an exterior plastic material selected from the group consisting of polyurethane and synthetic plastic formed onto at least a portion of the tube retaining member to form a combination exterior plastic tube and cylindrical metal shaft with the exterior plastic tube having an exterior surface having a diameter;

the combination exterior plastic tube and cylindrical metal shaft inserted through one of the openings in the second hinge bracket made of metal, through an adjacent one of the aligned openings in the first hinge bracket made of metal, through another one of the openings in the first hinge bracket made of metal and through an adjacent one of the aligned openings in the second hinge bracket made of metal with no metal retaining member between the combination exterior plastic tube and cylindrical metal shaft and the aligned openings in the first and second hinge brackets made of metal so that the exterior plastic tube covers the cylindrical metal shaft at the locations of and between the aligned openings in the second hinge bracket made of metal and adjacent first hinge bracket made of metal and another first hinge bracket made of metal and adjacent another second hinge bracket made of metal, a portion of the cylindrical metal shaft not covered by the exterior plastic tube having the outer cylindrical surface retained at one end of the cylindrical metal shaft through the roller wheel and after insertion of the combination exterior plastic tube and cylindrical metal shaft through one of the openings in the second hinge bracket made of metal, through an adjacent one of the aligned openings in the first hinge bracket made of metal, through another one of the openings in the first hinge bracket made of metal and through an adjacent one of the aligned openings in the second hinge bracket made of metal, an opposite end of the cylindrical metal shaft also not covered by the exterior plastic tube; and wherein the diameter of the exterior surface of the plastic tube is greater than the diameter of the outer wall of the cylindrical metal shaft, each of the aligned openings in the first hinge bracket made of metal and the second hinge bracket made of metal having a diameter larger than the diameter of the exterior surface of the plastic tube of the combination plastic tube and cylindrical metal shaft;

wherein, the combination plastic tube and cylindrical metal shaft prevents metal-to-metal contact between the outer wall of the cylindrical metal shaft and the first hinge bracket made of metal and the second hinge bracket made of metal.

10. The noise reducing roller wheel assembly of claim 9, wherein the first wheel section and the second wheel section are made of polyoxymethylene.

11. The noise reducing roller wheel assembly of claim 9, wherein the tire directly contacts the garage door track.

12. The noise reducing roller wheel assembly of claim 9, wherein the roller wheel has a diameter between 1.5 inches and 2.5 inches.

* * * * *